United States Patent [19]

Miyata et al.

[11] 3,976,372

[45] Aug. 24, 1976

[54] ELECTROPHOTOGRAPHICAL REPRODUCTION OF A MULTICOLOR IMAGE

[75] Inventors: Shizuo Miyata, Osaka; Yoshihide Nakao, Nara; Koichi Irihara, Nara; Ryoichi Kawai, Nara; Motokazu Nakao, Sakurai, all of Japan

[73] Assignee: Sharp Kabushiki Kaisha, Osaka, Japan

[22] Filed: Nov. 13, 1974

[21] Appl. No.: 523,511

[30] Foreign Application Priority Data

| | | |
|---|---|---|
| Nov. 13, 1973 | Japan | 48-127596 |
| Nov. 20, 1973 | Japan | 48-130451 |
| Nov. 20, 1973 | Japan | 48-130452 |
| Nov. 20, 1973 | Japan | 48-130453 |
| Nov. 21, 1973 | Japan | 48-131241 |

[52] U.S. Cl. ..... 355/4; 355/10

[51] Int. Cl.[2] ..... G03G 15/01

[58] Field of Search ..... 355/10, 4, 3 R; 96/1.2

[56] References Cited

UNITED STATES PATENTS

| | | | |
|---|---|---|---|
| 3,130,655 | 4/1964 | Meyer et al. | 96/1.2 X |
| 3,709,593 | 1/1973 | Matsumoto et al. | 355/4 |
| 3,738,743 | 4/1971 | Hoffman et al. | 355/3 R |
| 3,810,693 | 5/1974 | Matsumoto et al. | 355/4 |
| 3,838,920 | 10/1974 | Terashima et al. | 355/4 |
| 3,848,990 | 11/1974 | Otubo et al. | 355/4 |

*Primary Examiner*—R. L. Moses

*Attorney, Agent, or Firm*—Stewart and Kolasch, Ltd.

[57] ABSTRACT

A multicolor electrophotography apparatus and method wherein a photoconductive copy sheet surface containing uniform electric charge is exposed to an original through light filter which enables one color to be recorded, is developed with colored toner to produce a copy of that color, and the sequence is repeated for each of the other colors, utilizing superimposing toner images on the same copy sheet. In a preferred embodiment a sheet carriage is adapted to hold the copy sheet at its upper edge portion and carry it only in a certain direction for example in a vertical direction whereas a developer bed on which a plurality of developer reservoirs, each containing different colored developer toners are mounted, is adapted to travel in the other direction for example in the horizontal direction. During travel of the sheet carriage in the vertical direction, the photosensitive copy sheet passes through a charge deposition station, an exposure station and a development station thereby accomplishing reproduction of an image of one specified color. These steps may be repeated in as many colors as desired, for example, with accompanying movement of the developer bed so as to position the succeeding developer reservoirs containing different colored toners in the path of the sheet carriage, to produce, in as many colors as desired, a composite color image.

5 Claims, 5 Drawing Figures

ELECTROPHOTOGRAPHICAL REPRODUCTION OF A MULTICOLOR IMAGE

BACKGROUND OF THE INVENTION

The present invention relates to a multicolor electrophotography apparatus for making a multicolor image by superimposing a plurality of colored images on the same copy sheet.

The manner of obtaining an electrostatic image upon a charged surface is well known in the art of electrophotography and may be carried out in any one of several ways known as the "Electrofax method". A typical process may include for example, producing an over-all electrostatic charge on the surface of a photoconductive sheet such as selenium, or zinc oxide dispersed in an insulating binder. A light image is focused on the charged surface, discharging the portions irradiated by the light rays, while leaving the remainder of the surface in a charged condition, to thus form a latent image. The latent image is rendered visible by applying a developer toner and then held to the charged areas of the surface. The toner image thus formed may be fixed directly to the photoconductive sheet.

Reproduction of images in a plurality of colors, in general, consists of forming of a uniform electrostatic charge over the surface of the photosensitive sheet by virtue of corona behavior, exposing the photosensitive sheet to an original through light filters which enable one color latent image to be recorded, and then rendering the color latent image visible by development with colored toner. The procedure is repeated for each color by superimposing the color images on the same photoconductive sheet.

Nevertheless, registration of the separate images is the greatest problem associated with the production of plural color images.

An object of the present invention is to provide an improved multicolor electrophotography apparatus which insures that one color image will be superimposed in exact registration with another upon a copy sheet.

Another object of the present invention is to provide an improved multicolor electrophotography apparatus which simplifies the construction for carrying a photosensitive copy sheet over stations, for example, the series of a charge formation station, the exposure station and the development station.

A further object is to provide an improved multicolor electrophotography apparatus which insures that a photosensitive copy sheet will be held at an exact even plane during exposure.

BRIEF DESCRIPTION OF THE DRAWINGS

Other objects and many of the attendant advantages of the present invention will be readily appreciated as the same becomes better understood by reference to the following detailed description when considered in conjunction with the accompanying drawings in which like reference numerals designate like parts throughout the figures thereof and wherein.

DESCRIPTION OF THE PREFERRED EMBODIMENTS

Figure 1:
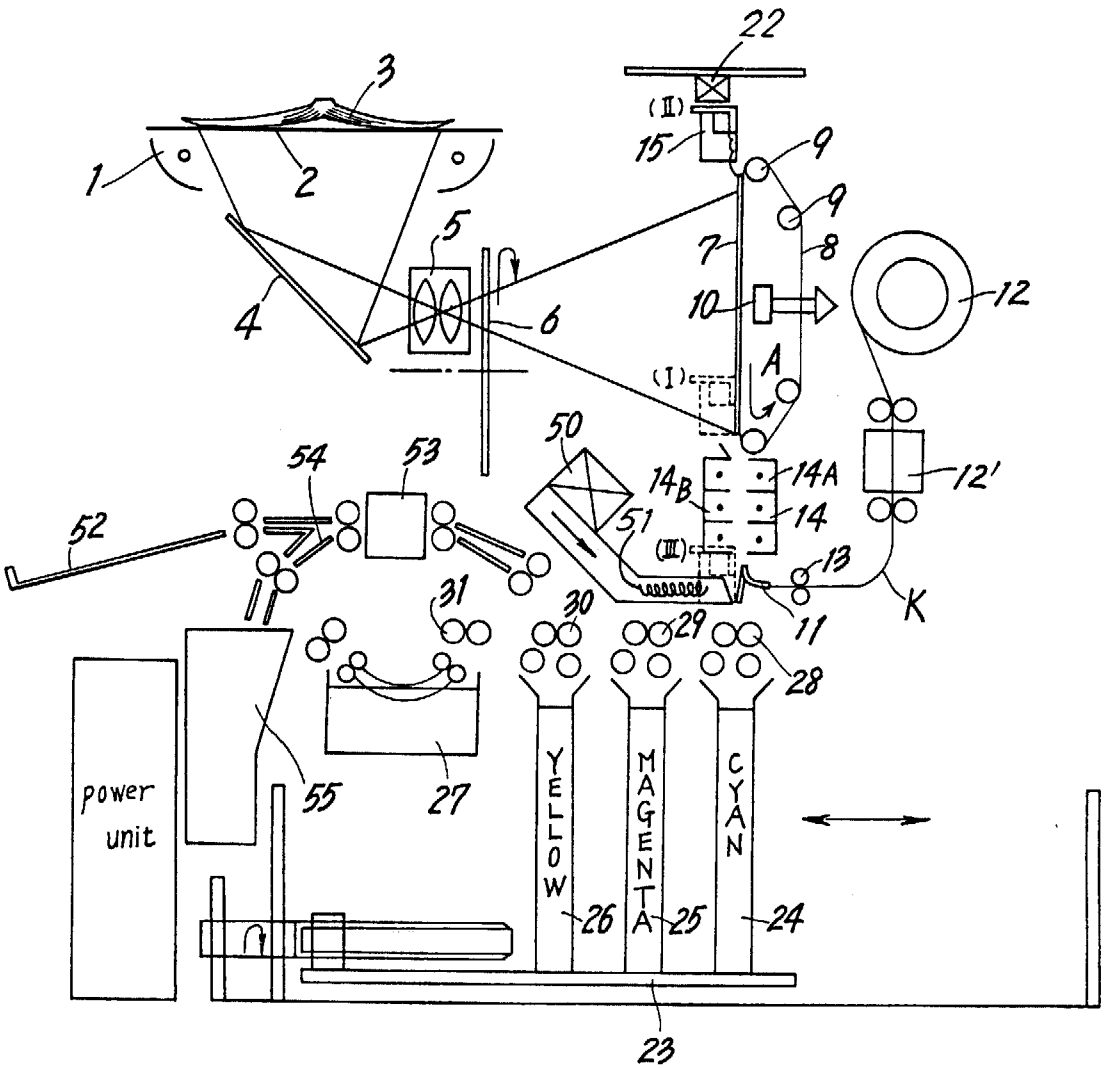
FIG. 1 is a schematic illustration of a multicolor electrophotography apparatus embodying the present invention.

Referring now to FIG. 1, there is illustrated an overall layout of a multicolor electrophotography apparatus embodying the present invention, which comprises as a rule a charge formation station, an optical exposure station, a development station, a fixing station and a paper supply station.

A light source 1 is secured below a glass plate 2 on which there is mounted an original 3 to be duplicated. Light rays reflected downward from the original 3 impinge on a reflector mirror 4, which directs an optical image of the original 3 toward an exposure position through a lens unit 5 and a color filter disc 6. The filter disc 6 which carries a plurality of different colored filters, for example, a red colored filter, a green colored filter, a blue colored filter and colorless filter, is provided for rotation about a fixed point so that the optical image projected on the exposure position changes in color with the rotation of the filter disc 6.

A paper holding table 7 of a hollow construction positioned parallel to and adjacent to the exposure surface, has preferably a length somewhat longer than the maximum size of a photosensitive copy sheet used with the present copying machine and a number of apertures which will be described below in more detail. A plurality of conveying belts 8 travel above the top surface of the paper table 7 in the parallel relationship to each other with the use of a predetermined number of rollers 9, the direction of the conveying belts 8 being marked by the arrows A, namely counter-clockwise direction. One of the rollers is coupled with a driving system. The apertures mentioned above are positioned on the surface of the paper table 7 on which no conveying belts 8 are provided, so that they communicate with a fan 10. An extension force of the conveying belt 8 and an attraction force of the fan 10 in combination are effective to prevent the copy sheet from deviating away from the exposure position and thereby causing the copy sheet to fit perfectly to the even surface of the paper table 7.

The photosensitive copy sheet K supplied from a roll 12 travels through a cutting unit 12', rollers 13, a paper guide 11 a corona charging unit 14 toward the lowest edge position of the paper table 7. A paper carriage 15 arrests the photosensitive copy sheet K at the lowest edge position of the paper table 7 and transports and carries the same upward along the even surface of the paper table 7. The paper guide 11 is rotatably provided to move away from the course of the travelling copy paper K. Furthermore, the corona charging unit 14 comprises a stationary section 14A and a movable section 14B, the latter being rotatable thereby deviating from the course of travel of the copy paper K while the copy sheet K travels upward and downward.

Figure 2:
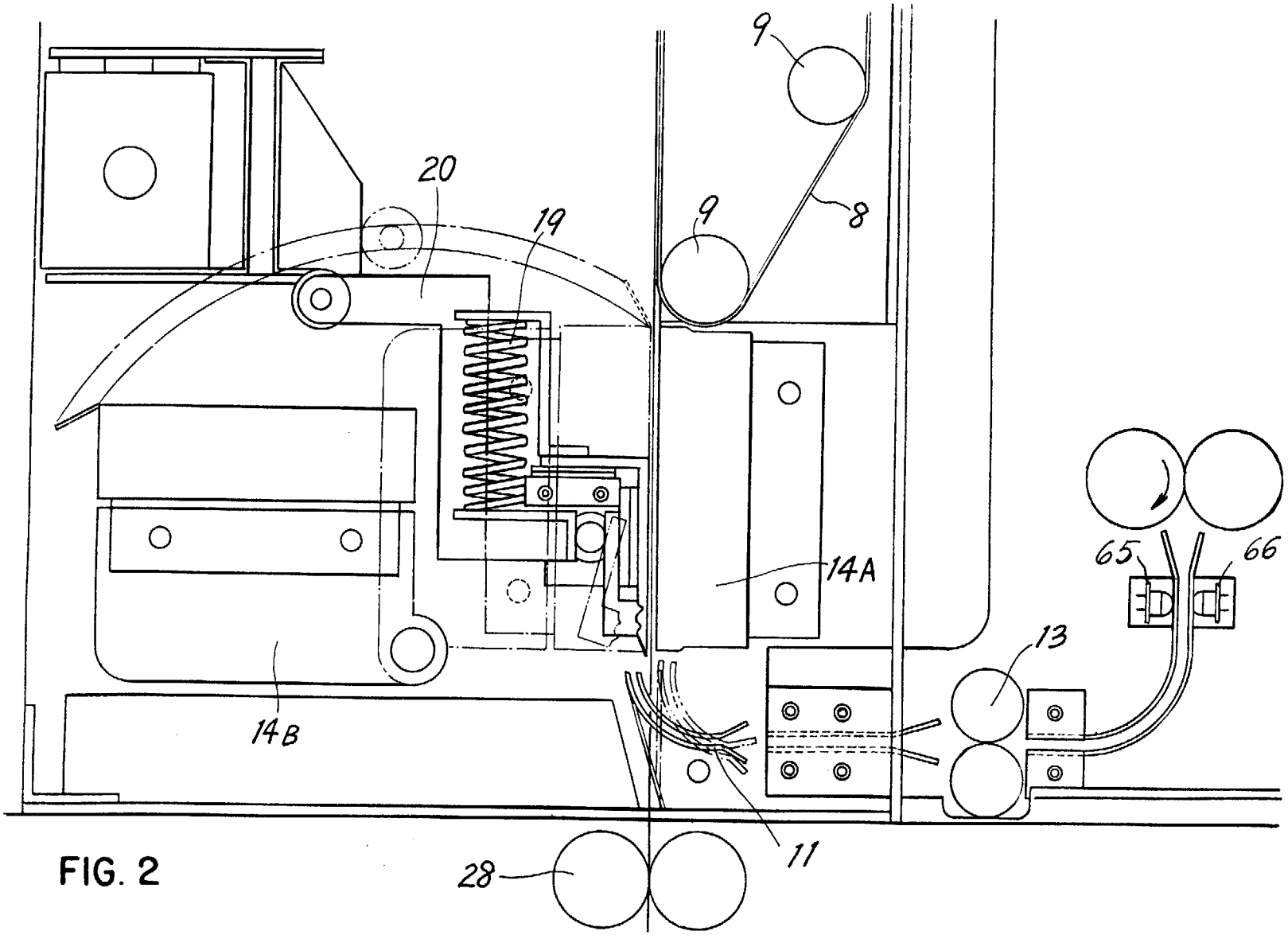
FIG. 2 is a partially sectional view of a paper carrying scheme of the apparatus of FIG. 1.
Figure 3:
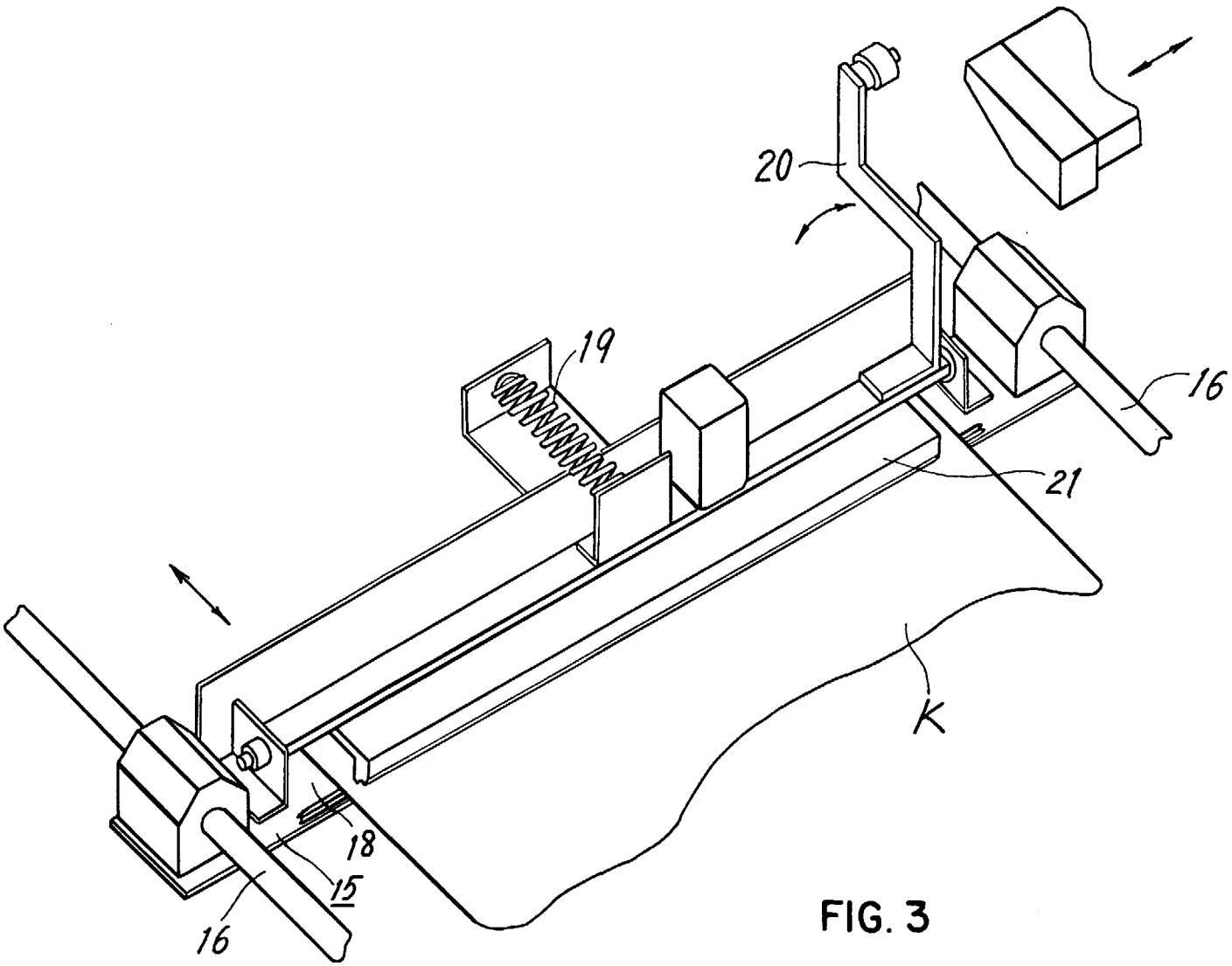
FIG. 3 is a perspective view of a paper catching and holding means of the apparatus of FIG. 1.

Referring now to FIG. 2 and FIG. 3, the paper carriage 15 briefly discussed above is movably supported by means of a pair of guide rails 16 which in turn are positioned in the vertical direction, such that the copy paper K travels together with the paper carriage 15 in the fixed or same course defined by the guide rails 16. The paper carriage 15 comprises a teeth-shaped stationary arm 18, a teeth-shaped movably arm 21, an actuator lever 20 and an extension spring 19, these components moving together in union with upward and downward movements of the copy paper K. Mechanical engagement between the both arms 18 and 21 serves to arrest and keep the copy paper K therebetween until the full cycle of the multicolor copying operation is perfectly completed. A holding solenoid 22 is energized only when the paper carriage 15 arrives at the uppermost position.

Referring now to FIG. 1, a development station comprises a developer bed 23 which is adapted to move only in the horizontal direction, that is, perpendicular to the travelling course of the copy paper K. The developer bed 23 bears a plurality of developer reservoirs 24, 25, 26, 27 thereon, each containing different colored developer toners, for example, cyan developer toner, magenta toner, yellow toner and black toner, these colors corresponding to complementary colors of the filters 6 as already discussed above. The developer bed 23 may travel either intermittently or successively upon every completion of the single color image formation process. That is to say, the copy paper K passing past the charge formation station and the optical exposure station falls to the lowest edge position of the paper table 7 and then enters into one of the developer reservoirs 24 through 27, said developer reservoir being positioned beneath the lowest edge position of the table 7. The intermittent or successive movement of the developer bed 23 causes change in color of the developer reservoir positioned beneath the table 7. Rollers 28 through 31 conduct the copy paper K to the developer reservoirs 24 through 27. The driving force for the paper carriage 15 may be afforded by any appropriate means well known in the art for example a motor. In addition, it will be noted that the conveying belt 8 travels in the direction opposite to that of the paper carriage 15 only when the latter travels upward. In short, the copy paper K enters into first the cyan colored developer reservoir 24 and returns to the charge formation station and the exposure station and then falls into the next succeeding magenta developer reservoir 25. It follows that the magenta color developed image is superimposed on the cyan color developed image. Thereafter, the yellow colored development and the black colored development are successively accomplished on the same copy paper K. A fixing station which comprises a dryer fan 50 and a heater filament 51 is deposited between the development station and the charge formation station. After the multicolor copying operation the copy paper K is fed to a paper tray 52 via a cutter 53 and a selector, whereas the waste paper cut away from the copy paper K is conducted to a paper drain 55. As noted earlier, the copy sheet K has in its travelling course three fixed positions as identified by (I), (II) and (III).

Figure 4:
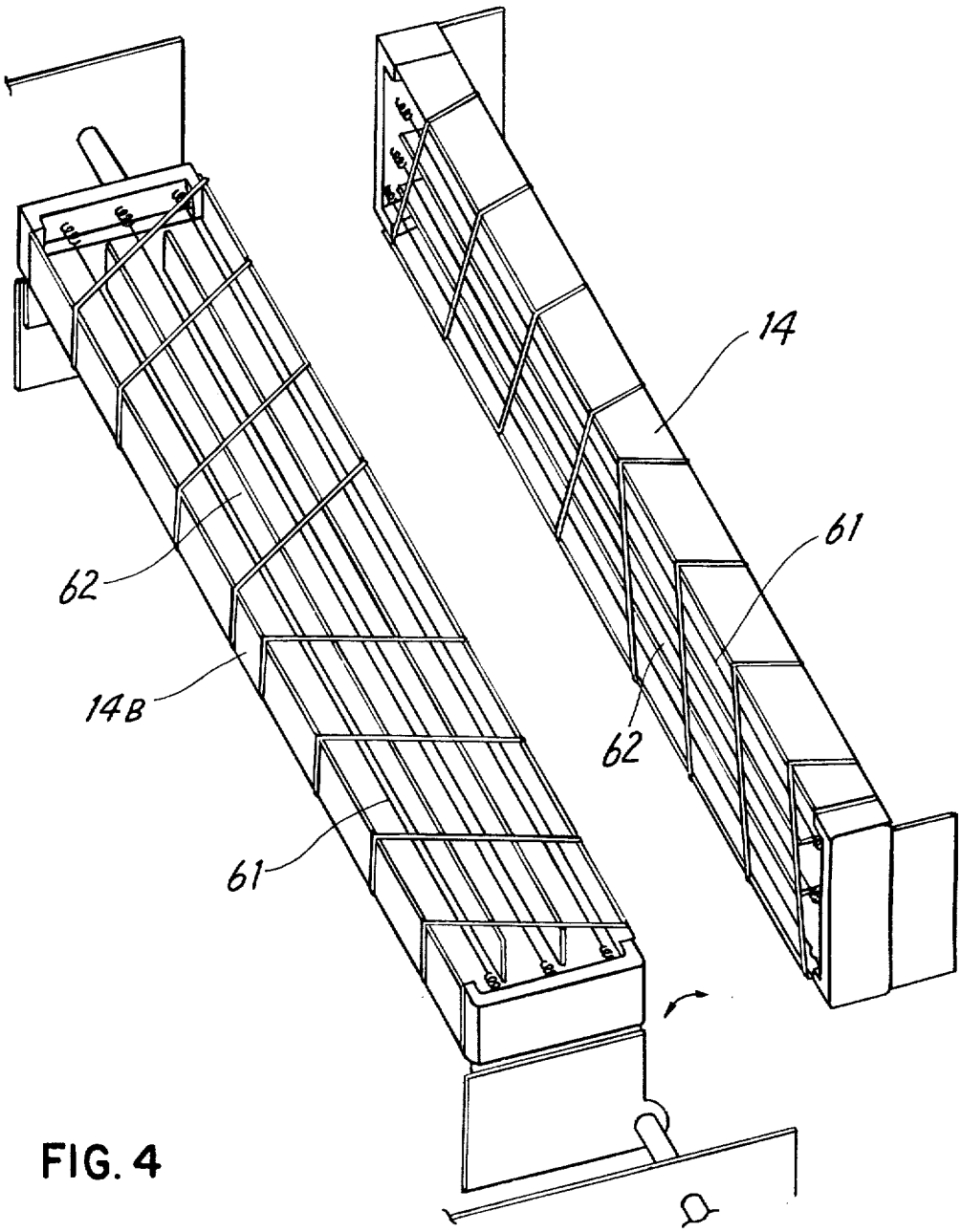
FIG. 4 is a perspective view of a separable charging means of the apparatus of FIG. 1.

In FIG. 4, there is shown in more detail the corona charging unit 14. A separable boxlike housing includes the stationary portion 14A and the movable portion 14B, each containing one or more tungsten wires 61 which are stretched throughout the housing and supplied with a considerable high positive voltage, e.g. 5 to 7 KV. The copy paper K travels intermediate the stationary portion 14A and the movable portion 14B while being led to ground potential so that a uniform charge image is attached to the copy paper K before passing the exposure station. Shield plates 62 are positioned between the two adjacent wires 61.

The multicolor image forming and copying function in the embodiment discussed in conjunction with FIGS. 1 through 4 will be better understood after a reading of the following description.

First of all, the original 3 is manually mounted on the glass plate 2 and, upon a switch being thrown, the photosensitive copy paper K from the supply roll 12 is sent the lowest edge portion of the paper table 7 via the roller 13 and the movable guide 11. In the course toward the lowest edge of the paper table 7, the copy paper K travels across the corona charging unit 14 so that a uniform electric charge latent image is formed on the copy paper K. If the trailing edge of the photosensitive paper K arrives at the position (I) where the paper carriage 15 is awaiting for the paper K, then this will cause the actuator lever 20 to be active to arrest and hold the trailing edge of the copy paper K between the two teeth arms 18 and 21. Then, the paper carriage 15 is driven to initiate an upward movement together with the copy paper K. Immediately after or immediately before this initiation of the upward movement of the paper carriage 15, the fan 10 is activated to create an air stream as marked by the arrow as well as activation of the conveying belt 8. Consequently, as the paper carriage 15 initiates its upward movement the copy paper K is stretched downward thereby forcing it into agreement with the even surface of the paper table 7 in cooperation with the suction force of the fan 10.

When the uppermost position (II) is reached by the paper carriage 15, the entire length of the copy paper K is fully positioned parallel to the paper table 7 or the exposure position. At this time the holding solenoid 22 becomes operative to attract and hold the paper carriage 15 at the uppermost fixed position (II) so that the entirety of the copy paper K extends over the surface of the Table 7. In a short time the belt 8 is stopped.

When the copy paper K is stopped at the exposure position in this manner, the optical system provides light irradiation of red color for the photosensitive surface of the copy receipt paper K. Thereafter, upon the completion of the light irradiation or exposure, the holding solenoid 22 is disconnected from the power circuit to initiate a downward movement of the paper carriage 15. It is of importance for the illustrative embodiment that the paper guide 11 is displaced from the course of the travelling copy paper K immediately before initiating said downward movement of the copy paper K or during the red light irradiation. This enables the copy paper K to fall along with the paper carriage 15. The rollers 28 serve to convey the copy paper K down to the cyan colored developer reservoir 24. This is accomplised at the position (III). Under these circumstances the development is effected with the cyan colored developer toner.

After the completion of the cyan colored development, the paper carriage 15 again initiates an upward movement so that the copy paper K bearing the cyan colored image thereon also rises again, receiving the actions of the conveying belt 8 and the fan 10. The paper carriage 15 which reaches the intermediate position (I) again, causes the movable section 14B of the charging unit 14 to return to its original position. This results in establishing a uniform charge image on the copy paper K.

When the carriage 15 arrives at the uppermost position (II), then the holding solenoid 22 is activated to hold the entirety of the copy paper K at the precise exposure position. Under these circumstances the optical system applies light irradiation of green light beams to the photosensitive paper K and then the development with the magenta colored developer is carried out in the same manner as discussed above. The repetition of these steps results in the successive developments with the cyan, magenta and yellow toners onto the photosensitive paper K.

If the black colored development is desired as the last step, the light which does not pass through a colored filter is irradiated on the photosensitive paper K via the optical system and the photosensitive paper K is conducted to a cutter 53 after passing through the developer reservoir 27.

Upon the completion of the multicolor development the photosensitive paper K is free from the engagement of the paper carriage 15 and then sent to the paper tray 52 via appropriate roller means (not shown in the figures). Meanwhile, the paper carriage 15 arresting or holding no copy paper K is caused to rise to the home position (1). Simultaneously, the paper guide 11 and the movable section 14B of the charging unit 14 return to their original positions as shown by the solid lines. It will be understood that the filters within the disc 6 should change in order in correspondence with the colors of the developer toners and the operative color filter 6 is therefore substantially in the complementary color relationship to the operative developer toner. The movements of the photosensitive paper K and the paper carriage 15 may be easily controlled by conventional means as already known to one skilled in the art. For instance, in the illustrative embodiment such control may be accomplished by a pair of light emitting semiconductor element 65 and a photo-sensitive semiconductor element 66, and electric signals derived from the element 66 are useful to control the movement of the copy paper K.

Figure 5:
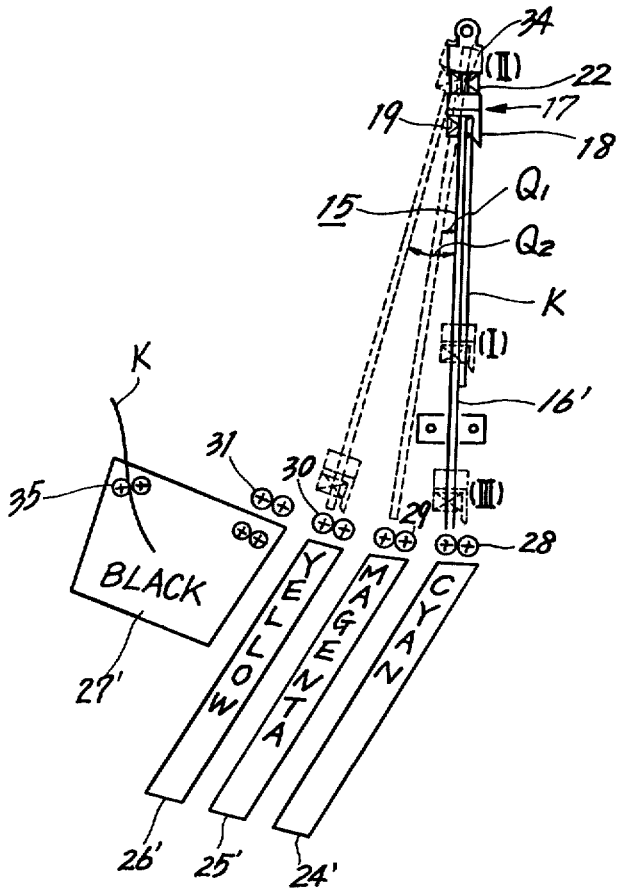
FIG. 5 is a modification of a paper carrying scheme.

FIG. 5 shows a modification of the multicolor copying machine embodying the present invention. A plurality of developer reservoirs 24' through 27', each containing cyan colored developer toner, magenta colored developer toner, yellow colored developer toner and black developer toner are secured at the respective stationary positions, while the upper end of a guide rail 16' is fixed at an appropriate holding or suspending means 34. The paper carriage 17 is adapted to slide along the guide rail 16' and comprises a pair of catching arms 18, 21 and an actuator lever 20 as discussed above.

In the first exposure process, the guide rail 16' does not rotate but only the paper carriage 17 travels upward and downward so that the photosensitive paper K enters into the cyan developer reservoir 24'. During the next exposure process the guide rail 16' remains at its stationary position, but after completion of the exposure the guide rail 16' rotates a predetermined angle Q1 due to the action of the holding means 34. Then, the paper carriage 15 falls along the guide rail 16' with the result that the photosensitive paper K enters into the magenta developer reservoir 25'.

Thereafter, upon completion of the magenta development the paper carriage 15 moves upward and, when the desired upper position is reached, the guide rail 16' is returned to its original position marked by the solid line by means of the action of the holding means 34. The further development is effected under these circumstances, and then the guide rail 16' rotates by a second desired angle Q2 in a manner so as to guide the copy paper K to the yellow developer reservoir 26'. These steps are repeated to complete the multicolor copying function.

The invention being thus described, it will be obvious that the same may be varied in many ways. Such variations are not to be regarded as a departure from the spirit and scope of the invention and all such modifications are intended to be included within the scope of the following claims.

We claim:

1. A multicolor electrophotographic machine comprising an image receipt sheet supply station for supplying image receipt sheets, a charge formation station for forming a uniform charge on the image receipt sheet, means for conveying the image receipt sheet from said supply station to said charge formation station, a stationary light exposure station for applying an image to the image receipt sheet, a development section comprising a plurality of aligned developer reservoirs, each containing a different color developer toner, means for shifting the development section containing said aligned developer reservoirs to move in the aligned direction, a plurality of pairs of guide rollers installed above the respective developer reservoirs comprising said development section for conducting the image receipt sheet into the respective developer reservoirs, a sheet carriage for grasping the image receipt sheet and conducting the same, in sequence, to the charge formation station, concurrently with the shifting of the development section from one developer reservoir to another developer reservoir and a stopper means for determining a stationary position of the sheet carriage in the light exposure station.

2. The multicolor electrophotographic machine as set forth in claim 1, wherein the charge formation station includes a movable section adapted to rotate away from the course of travel of the receipt sheet during the development operation.

3. The multicolor electrophotographic machine as set forth in claim 1, wherein the sheet carriage is slidably supported by a pair of stationary guide rails, said guide rails being disposed substantially perpendicular to the shift direction of the development section.

4. The multicolor electrophotographic machine as set forth in claim 1, wherein the stopper means comprises a solenoid for holding the sheet carriage at its uppermost position which corresponds to the light exposure station.

5. A multicolor electrophotographic machine comprising an image receipt sheet supply station for supplying image receipt sheets, a charge formation station for forming a uniform charge on the image receipt sheet, means for conveying the image receipt sheet from said supply station to said charge formation station, a stationary light exposure station for applying an image to the image receipt sheet, a development section comprising a plurality of aligned developer reservoirs, each containing a different color developer toner, a plurality of pairs of guide rollers installed above the respective developer reservoirs comprising said developer section for conducting the image receipt sheet into the respective developer reservoirs, a sheet carriage for grasping the image receipt sheet and conducting the same, in sequence, to the charge formation station, the light exposure station and the development station, said sheet carriage being pivotally suspended from one end thereof so that it is brought into selective alignment with the plurality of developer reservoirs, and a stopper means for determining a stationary position of the sheet carriage in the light exposure station.

* * * * *